United States Patent [19]

Gamble

[11] 3,977,596

[45] Aug. 31, 1976

[54] NEWSPAPER RECYCLING APPARATUS

[76] Inventor: Bruce Gamble, 815 Rosedale Ave., Lafayette, Calif. 94549

[22] Filed: Sept. 16, 1974

[21] Appl. No.: 506,090

[52] U.S. Cl. ..... 229/54 R; 150/7; 229/62

[51] Int. Cl.[2] ..... B65D 33/12; B65D 33/24

[58] Field of Search ..... 150/7, 1.7; 229/54 R, 229/54 C, 62, 84

[56] References Cited

UNITED STATES PATENTS

| | | | |
|---|---|---|---|
| 308,418 | 11/1884 | Lockwood | 229/54 C |
| 1,174,552 | 3/1916 | Dubois et al. | 229/54 C |
| 1,655,460 | 1/1928 | Galbraith et al. | 229/84 X |
| 2,272,938 | 2/1942 | Ferrante | 229/62 X |
| 2,722,311 | 11/1955 | Morrison | 229/3.1 X |
| 3,240,420 | 3/1966 | Membrino | 229/54 R |

*Primary Examiner*—Stephen P. Garbe
*Attorney, Agent, or Firm*—Townsend and Townsend

[57] ABSTRACT

Apparatus and method for bailing newspapers so that they can easily be transported for recycling is disclosed. The apparatus includes a paper bag having raised handles on each side of its open end. The bag is provided with a paper flap which is attached to one side of the bag adjacent the open end. One or more tabs are located at the free end of the flap and correspond with pairs of parallel slits formed in the other side of the bag. After newspapers have been inserted in the bag, the flap can be folded over the exposed ends of the newspapers and inwardly along the interior surface of the other side of the bag for engagement of the tab with the slits. The newspapers are thus encapsulated within the bag and can easily be transported by grasping the handles of the bag.

6 Claims, 8 Drawing Figures

NEWSPAPER RECYCLING APPARATUS

BACKGROUND OF THE INVENTION

The present invention relates to recycling systems, and in particular to apparatus and method for bailing newspapers so that they can easily be transported for recycling.

The increasing need for recycling paper and other materials to minimize the depletion of raw material resources is becoming more and more apparent. The depletion of natural timber resources, particularly for paper products and especially for newsprint, is rapidly becoming a critical problem. One of the obvious solutions to this problem is to recycle newspapers so that the newsprint is reused rather then continuously exhausting raw timber resources.

In the past, two problems have hindered the widespread acceptance of recycling newspapers. The first problem was that the monetary value of the recycled newspapers on a per ton basis was relatively small so that the expenses of collecting the newspapers outweighed the value. Economically feasible collection of the newspapers could only be performed by volunteer organizations, such as boy scout troops and the like. The other problem was that of the inconvenience of typing up bundles of newspapers and was sufficient to hinder the collection of the newspapers unless a secondary motivation such as charity were provided. The newspapers must be bundled and collected relatively frequently since large collections of loose newspapers present a fire hazard and may violate local fire regulations.

The recent increase in the value of raw newsprint has virtually eliminated the first problem mentioned above, and it is now becoming economically feasible and attractive to collect newspapers for recycling. Pilot programs have been initiated to determine whether the public is willing to accommodate newspaper recycling and accept the minor inconveniences involved in collecting and bundling the newspapers for periodic collection. These pilot programs have shown limited success, and the unwillingness of the public to put up with minor inconveniences such as bundling newspapers has proven to be difficult to overcome. Since used newspapers must be disposed by the consumer anyway, it would appear that a collection system which was no more inconvenient than normal trash disposal would avoid this public antipathy and render widespread recycling a feasible concept.

SUMMARY OF THE INVENTION

The present invention provides a convenient system for bailing newspapers so that they can easily be transported for recycling. The apparatus of the present invention includes a paper bag which is preferably formed using soluble glue. In its preferred embodiment, the paper bag is provided with handles on each side of the open end of the bag. The bag has a paper flap attached to one side which can be folded over the newspapers after the bag has been filled. A tab is provided at the free end of the flap and one or more slits are formed on the other side of the bag so that the flap is secured in its folded configuration. In the preferred embodiments of the present invention, the flap is adapted to fold inwardly along the interior surface of the other side of the bag, and the tab is inserted outwardly and then inwardly through a pair of slits so that the handles of the bag are exposed for easy carrying of the newspapers.

Newspapers can be collected and inserted in the paper bag on a daily basis as they are used much as ordinary trash is now collected in a trash bag. As a result, the present method for collecting newspapers is as convenient as collecting ordinary trash. Furthermore, the preferred embodiment of the present invention provides handles on the bag so that the collected newspapers can easily be carried to the designated location for periodic collection. The basic size of the bag is similar to the normal shopping bags used in supermarkets which may issue them as a sales promotion and the bags themselves can carry advertising on the sides. The bags are preferably made of soluble glue so that the paper bags themselves can also be recycled. The newspapers contained in the paper bags can easily be collected with periodic garbage collection and stored in a separte container in the truck, usually between the wheels beneath the truck bed. The value of the collected newspapers is now such that there is an economic incentive for the trash collector to collect the newspapers and carry them to a recycling center.

The novel features which are characteristic of the invention, as to organization and method of operation, together with further objects and advantages thereof, will be better understood from the following description considered in connection with the accompanied drawings which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
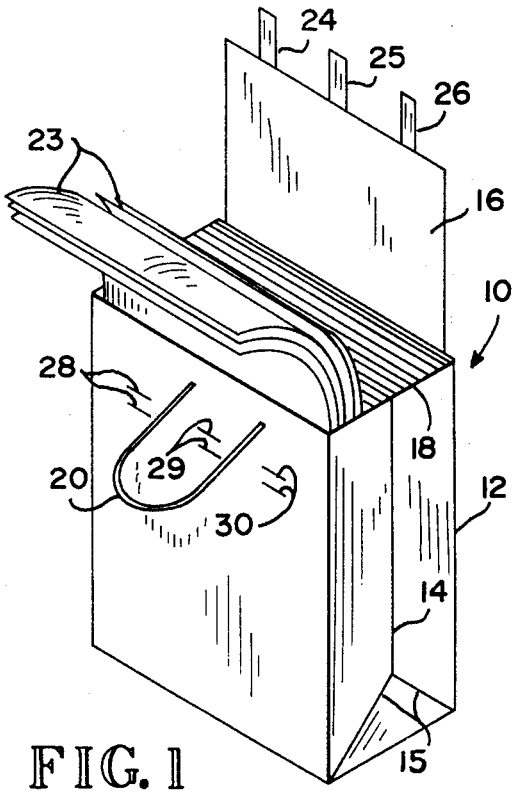
FIG. 1 is a perspective view illustrating the collection of newspapers for recycling according to the teachings of the present invention.
Figure 2:
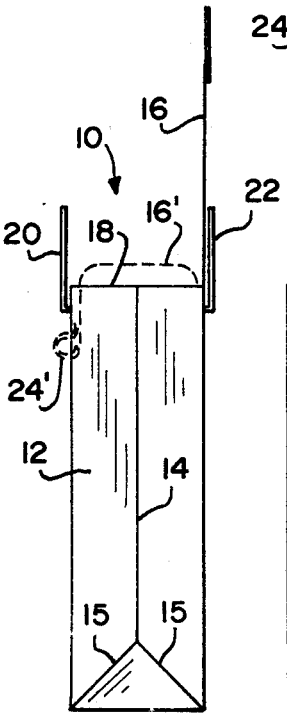
FIG. 2 is an end elevation view of one of the preferred embodiments of the present invention.
Figure 3:
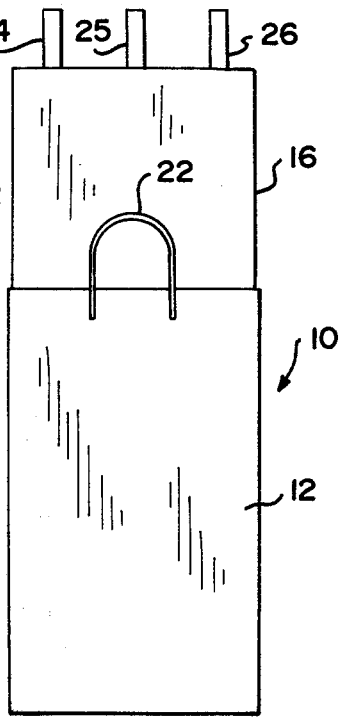
FIG. 3 is a side elevation view of the embodiment of FIG. 2.

One embodiment 10 of the paper bag of the present invention is illustrated by way of reference to FIGS. 1-3. Embodiment 10 includes an upwardly opening paper bag body 12 which is formed by folding the paper and glueing it along seams such as 14, 15 with water-soluble glue. A paper flap 16 extends upwardly from one side of paper bag body 12 adjacent the open end 18 thereof. A pair of handles 20, 22 are attached to the paper bag body 12 adjacent open end 18, handle 22 being disposed on the exterior of flap 16.

A plurality of newspapers such as 23 can be easily inserted into paper bag body 12 through open end 18. After the newspapers are inserted, flap 16 can be folded over the disposed ends of the newspapers as illustrated at 16' in FIG. 2. A plurality of tabs 24-26 are located on the free end of flap 16, and a row of corresponding parallel slits 28–30 are formed in bag body 12 opposite from the attachment of flap 16. Flap 16 can thus be folded along the inside surface of bag body 16 to enclose the newspapers 23 therein, and the tabs such as 24 inserted outwardly through one of the parallel slits 30 and inwardly through the other to encapsulate the newspapers in the bag.

Figure 4:
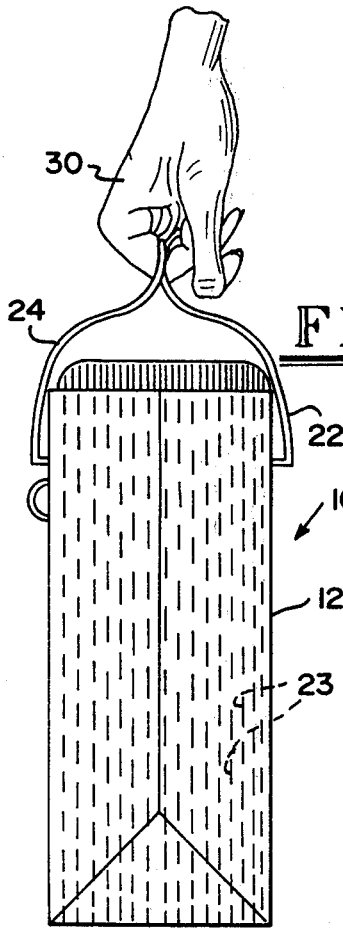
FIG. 4 illustrates the manner of carrying the newspapers for recycling using the embodiment of the present invention illustrated in FIGS. 2 and 3.

After newspapers 23 have been encapsulated in bag body 12, handles 20, 22 remain exposed as illustrated in FIG. 4. This allows a person to use his hand 30 to grasp the handles for easy carrying of the newspapers. Embodiment 10 is constructed using soluble glue so that the entire unit including newspapers, paper bag, and handles can be fully recycled.

Figure 5:
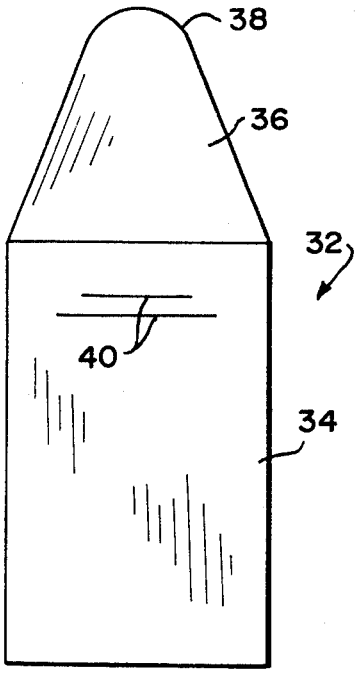
FIG. 5 is a side elevation view of a second embodiment of the present invention.

A second embodiment 32 of the present invention is illustrated by way of reference to FIG. 5. Embodiment 32 includes paper bag body 34 as illustrated in the previous embodiment. However, flap 36, attached to one side of bag body 34 adjacent its opened end, is tapered and comes to a single point 38 forming a tab. Tab 38 can readily be folded over the newspapers and inserted through parallel slits 40 to bail the newspapers. The disadvantage of the embodiment 32 illustrated in FIG. 5 is that no handles are provided on the bag body, making it relatively more difficult to carry than the initial embodiment.

Figure 6:
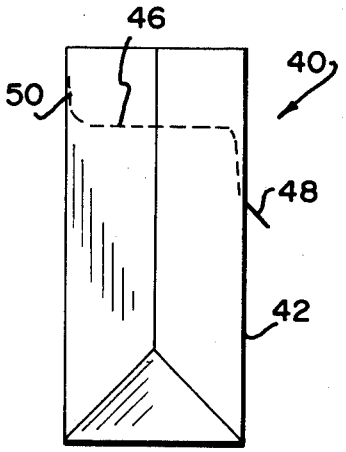
Figure 7:
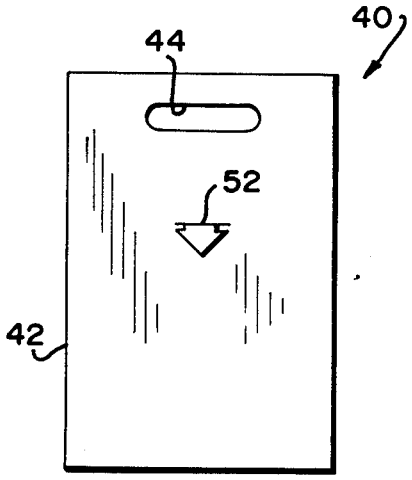
Figure 8:
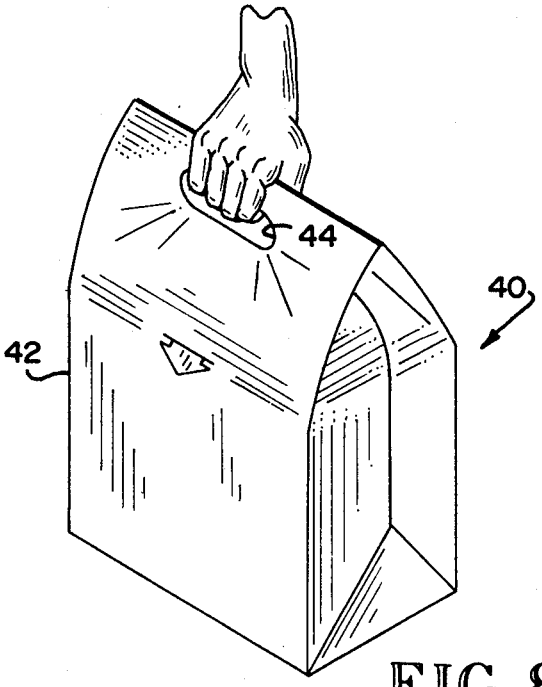

A third embodiment 40 of the present invention is illustrated by way of reference to FIGS. 6–8 in combination. Embodiment 40 includes a standard rectangular paper bag body 42 provided with slots 44 on either side which can be used as a handle. A flap 46 is provided on the interior of bag body 42 and has an arrow-shaped tab 48 at the free end thereof. Flap 46 is attached to bag body 42 at 50 so that flap 46 normally projects downwardly inside the bag so that the bag can be initially used for purposes other than bailing newspapers as a standard paper bag. Bag body 42 has a configuration generally similar to a supermarket bag with slightly raised sides.

Newspapers can be collected and stacked inside bag body 42 as in the previous embodiments. The height of bag 42 is such that the newspapers will not extend to the top of the bag but rather a few inches clearance will be allowed. Flap 46 can thus be folded over the tops of the newspapers and then downwardly and inwardly along the inside surface of the far side of the bag as illustrated in FIG. 6. Arrow-shaped tab 48 can then be inserted through a complementary slit 52 to lock the flap 46 in position (see FIG. 7). The newspapers can then be easily transported for recycling by grasping bag body 42 through slots 44 which provide a handle, as illustrated in FIG. 8.

While preferred embodiments of the present invention have been set forth in detail, it is apparent that modifications and adaptations of these embodiments will occur to those skilled in the art. However, it is to be expressly understood that such modifications and adaptations are within the spirit and scope of the present invention as set forth in the following claims.

What I claim as new is:

1. Apparatus for bailing newspapers so that they can easily be transported for recycling, said apparatus comprising a paper bag having a normally open end with a handle on each side of the bag at said open end and an interior volume adapted to receive a stack of newspapers defined by at least two opposed sides terminating at the open end, said bag having a paper flap having one end attached to one said side of the bag adjacent the open end and an opposite free end, at least one tab at the free end of the flap and at least one slit formed in the other side of the bag, said flap adapted to extend over the exposed ends of the newspapers at the open end of the bag and fold inwardly along the interior surface of said other side of the bag for insertion of the tab outwardly through the slit to encapsulate the newspapers in the bag for carrying with the handles.

2. Apparatus as recited in claim 1 wherein the width of the flap along its length from said one end to said free end is coextensive with the width of the paper bag, wherein the free end of the flap has three parallel tabs, and wherein the bag has a row of three pairs of parallel slits formed in the other side thereof for completely enclosing the newspapers in the bag.

3. Apparatus as recited in claim 1 wherein the paper bag is constructed using soluble glue for recycling of the paper bag as well as the newspapers.

4. Apparatus for bailing newspapers so that they can easily be transported for recycling, said apparatus comprising a paper bag having a rectangular cross-section and including a normally open end with a raised handle on each side of the bag at said open end and an interior volume adapted to receive a stack of newspapers, said bag having a rectangular paper flap having one end attached to one side of the bag adjacent the open end and a free end opposite from said one end, said flap having a width substantially coextensive with the width of the bag, a plurality of tabs at the free end of the flap and a plurality of pairs of parallel slits formed in the side of the bag opposite said one side, said flap adapted to extend over the exposed ends of the newspapers at the open end of the bag and fold inwardly along the interior surface of the other side of the bag for insertion of the tabs outwardly through one of the slits of each said pair and inwardly through the other slit of each said pair to fully encapsulate the newspapers in the bag so that they can be convieniently carried with the handles.

5. Apparatus for bailing newspapers so that they can easily be transported for recycling, said apparatus comprising a paper bag having an interior volume defined by at least two opposing sides and adapted to receive a stack of newspapers through a normally open end of said bag, said bag including juxtaposed slots formed in the opposing sides thereof adjacent the open end to provide a handle, said bag having one end of a paper flap attached to the interior of one said side of the bag adjacent the open end, the other end of the paper flap providing a free end, an arrow-shaped tab at the free end of the flap, and a slit formed in the other said side of the bag, said flap adapted to extend over the exposed ends of the newspapers at the open end of the bag and fold inwardly along the interior surface of said other side of the bag for insertion of the tab through the slit to encapsulate the newspapers in the bag for carrying with the handle.

6. Apparatus for bailing newspapers so that they can easily be transported for recycling, said apparatus comprising a paper bag having an interior volume defined by at least two opposing sides and adapted to receive a stack of newspapers through a normally open end of said bag, said bag including juxtaposed slots formed in the opposing sides thereof adjacent the open end to provide a handle, said bag having one end of a paper flap attached to the interior of one said side of the bag adjacent the open end, the other end of the paper flap providing a free end, a tab at the free end of the flap, and a slit formed in the other said side of the bag, said flap adapted to extend over the exposed ends of the newspapers at the open end of the bag and fold inwardly along the interior surface of said other side of the bag for insertion of the tab through the slit to encapsulate the newspapers in the bag for carrying with the handle.

* * * * *

UNITED STATES PATENT AND TRADEMARK OFFICE

CERTIFICATE OF CORRECTION

PATENT NO. : 3,977,596

DATED August 31, 1976

INVENTOR(S) : BRUCE GAMBLE

It is certified that error appears in the above-identified patent and that said Letters Patent are hereby corrected as shown below:

Column 2, under the Section entitled "Brief Description of the Drawings" insert the following:

--Fig. 6 is an end elevation view of a third embodiment of the present invention;

Fig. 7 is a side elevation view of the third embodiment;

Fig. 8 is a perspective view of the third embodiment of the present invention illustrating the manner in which this embodiment can be carried by the handles. --

Signed and Sealed this

Fifteenth Day of March 1977

[SEAL]

*Attest:*

RUTH C. MASON
*Attesting Officer*

C. MARSHALL DANN
*Commissioner of Patents and Trademarks*